US007666032B2

(12) United States Patent
Aoki et al.

(10) Patent No.: US 7,666,032 B2
(45) Date of Patent: Feb. 23, 2010

(54) SHIELDED CONNECTOR AND METHOD OF MANUFACTURING SHIELDED CONNECTOR

(75) Inventors: Eiji Aoki, Shizuoka (JP); Tomokazu Yamane, Shizuoka (JP); Takeaki Kaneko, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/491,705

(22) Filed: Jun. 25, 2009

(65) Prior Publication Data

US 2009/0260232 A1 Oct. 22, 2009

Related U.S. Application Data

(62) Division of application No. 12/244,112, filed on Oct. 2, 2008.

(30) Foreign Application Priority Data

Oct. 3, 2007 (JP) ..... P2007-259953

(51) Int. Cl.
*H01R 9/03* (2006.01)

(52) U.S. Cl. ..... 439/607.41; 29/844

(58) Field of Classification Search .....
439/607.41–607.51, 877, 879; 29/842, 844
See application file for complete search history.

(56) References Cited

U.S. PATENT DOCUMENTS

| | | | | |
|---|---|---|---|---|
| 7,438,597 | B1 * | 10/2008 | Scea et al. | 439/607.41 |
| 7,494,384 | B2 * | 2/2009 | Friedhof | 439/701 |
| 7,530,847 | B2 * | 5/2009 | Siems | 439/607.41 |
| 7,530,848 | B2 * | 5/2009 | Nagashima et al. | 439/607.41 |

FOREIGN PATENT DOCUMENTS

JP 2003-257264 A 9/2003

* cited by examiner

*Primary Examiner*—Khiem Nguyen
(74) *Attorney, Agent, or Firm*—Sughrue Mion, PLLC

(57) ABSTRACT

There is provided a method of manufacturing a shielded connector which includes: a terminal-attached wire; a housing containing the terminal of the terminal-attached wire; a shielded shell integrated to the housing; a knitted conductor mounted to the wire; and a shield ring interposing the knitted conductor between the shield ring and the shielded shell so that the knitted conductor is electrically connected to the shielded shell. The method includes: inserting, into the shielded shell, a single core having a stepped portion formed in a opposed drawing direction; bringing a contact portion formed at the shielded shell into contact with the core; covering the shield ring on the shielded shell via the knitted conductor; and calking the shield ring, the knitted conductor, and the shielded shell from outer side of the shield ring to form, on the shielded shell, a calk-deformed portion contained into the stepped portion of the core.

1 Claim, 7 Drawing Sheets

SHIELDED CONNECTOR AND METHOD OF MANUFACTURING SHIELDED CONNECTOR

This is a divisional of application Ser. No. 12/244,112 filed Oct. 2, 2008, The entire disclosure of the prior application, application Ser. No. 12/244,112 is considered part of the disclosure of the accompanying divisional application and is hereby incorporated by reference.

BACKGROUND OF THE INVENTION

1. Technical Field

The present invention relates to a shielded connector integrating a shielded shell electrically connected with a knitted conductor by way of a shield ring to a housing containing a terminal of a terminal-attached wire and a method of manufacturing such a shielded connector.

2. Background Art

As an example of a shielded connector and a method of manufacturing a shielded connector, as shown by FIG. 7, there is known a shielded connector 70 containing split pieces 71 split into four to a flame 73 so that an outline of a vertical section thereof orthogonal to a direction of fitting a shielded shell 72 can expand and contract by way of spring means, not illustrated, containing the split pieces 71 into a wire inserting portion 74 of the shielded shell 72, and covering a calking ring 76 onto the wire inserting portion 74 by way of a knitted conductor 75 to form by a press die (refer to, for example, Patent Reference 1).

[Patent Reference 1] JP-A-2003-257264 (FIG. 1)

However, according to the shielded connector 70 disclosed in Patent Reference 1 mentioned above, in order to manufacture the shielded shell 72, there is used a manufacturing apparatus of containing the split pieces 71 split into four to the flame 73 so that the outline of the vertical section orthogonal to the direction of fitting the shielded shell 72 can expand and contract by the spring means, and therefore, the apparatus is constituted by a complicated structure and is expensive, and therefore, not only the shielded shell is difficult to be manufactured simply but is disadvantageous in view of cost.

Further, a so-to-speak core of the split piece 71 or the like is divided, a pressure in calking is difficult to be concentrated, and therefore, a shape of a calked portion of a shielded shell becomes unstable and there is a concern that stable calking cannot be carried out.

SUMMARY OF THE INVENTION

The invention has been carried out in view of the above-described problem and it is an object thereof to provide a shielded connector which can be manufactured simply, is advantageous in view of cost and can carry out stable integration and a method of manufacturing a shielded connector.

The above-described object of the invention is achieved by the following constitution.

(1) A shielded connector, including:

a terminal-attached wire in which a terminal is connected to an end portion of a wire;

a housing which contains the terminal of the terminal-attached wire;

a shielded shell integrated to the housing;

a knitted conductor outwardly mounted to the wire; and a shield ring interposing the knitted conductor between the shield ring and the shielded shell, to be calked so that the knitted conductor is electrically connected to the shielded shell, wherein the shielded shell includes:

a calk-deformed portion which is formed by being calked in a state that a single core having a stepped portion is inserted into the shielded shell; and a contact portion which contacts a peripheral face of the core for maintaining a clearance formed by the stepped portion between the contact portion and the peripheral face of the core at a portion other than the calk-deformed portion.

(2) A method of manufacturing a shielded connector which includes:

a terminal-attached wire in which a terminal is connected to an end portion of a wire;

a housing containing the terminal of the terminal-attached wire;

a shielded shell integrated to the housing;

a knitted conductor outwardly mounted to the wire; and a shield ring interposing the knitted conductor between the shield ring and the shielded shell so that the knitted conductor is electrically connected to the shielded shell, the method including:

inserting, into the shielded shell, a single core having a stepped portion which is formed on a side opposed to a drawing direction of the core;

bringing a core contact portion formed at the shielded shell into contact with a peripheral face of the core;

covering the shield ring on the shielded shell by way of the knitted conductor; and calking the shield ring, the knitted conductor, and the shielded shell from an outer side of the shield ring so as to form, on the shielded shell, a calk-deformed portion which is contained into the stepped portion of the core.

According to the shielded connector of the constitution of (1), when the knitted conductor is calked by being interposed between the shield ring and the shielded shell, the single core inserted to the shielded shell is formed with the stepped portion on the side opposed to the drawing direction of the core (counter drawing side) to contain the calk-deformed portion formed at the shielded shell. Therefore, calking is carried out by containing the calk-deformed portion formed at the shielded shell in the stepped portion, and the core is drawn by way of the stepped portion formed on the counter drawing side after finishing the calking. Further, in carrying out the calking, the core contact portion is brought into contact with the core at a portion of the shielded shell, and therefore, the shielded shell is difficult to be deformed by a calking force exerted to the shielded shell, and a shape of the shielded shell can be maintained without deforming a entirety thereof. Thereby, in addition to that it is not necessary to divide the core as in the background art, the shielded connector can simply be manufactured, is advantageous in view of cost and can be integrated stably.

According to the method of manufacturing a shielded connector by the constitution of (2), when the single core is inserted into the shielded shell, the core contact portion of the shielded shell is brought into contact with the core, and the shield ring is covered onto the shielded shell by way of the knitted conductor. Next, the knitted conductor and the shielded shell are calked from the outer side of the shield ring. At this occasion, the core is formed with the stepped portion on a side opposed to the drawing direction of the core (the counter drawing side) to contain the calk-deformed portion formed at the shielded shell by the calking, and therefore, the core is drawn in the drawing direction after carrying out the calking. Further, in carrying out the calking, the core contact portion is brought into contact with the core at a portion of the shielded shell, and therefore, the shielded shell is difficult to be deformed by the calking force exerted to the shielded shell, and a shape which does not deform the entirety of the shielded shell can be maintained. Thereby, in addition to that it is not necessary to split the core as in the background art, the shielded connector can simply be manufactured, and is advantageous in view of cost and can stably be integrated.

According to the invention, in the shielded connector including the terminal-attached wire connecting the terminal to the end portion of the wire, the housing containing the terminal of the terminal-attached wire, the shielded shell integrated to the housing, the knitted conductor outwardly mounted to the wire and the shield ring interposing the knitted conductor between the shield ring and the shielded shell so that the knitted conductor can be electrically connected to the shielded shell, the shielded connector which can be manufactured simply, is advantageous in view of cost and can stably be integrated and the method of manufacturing the shielded connector can be provided.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferable embodiment according to the invention will be explained in details in reference to the drawings as follows.

Figure 1:
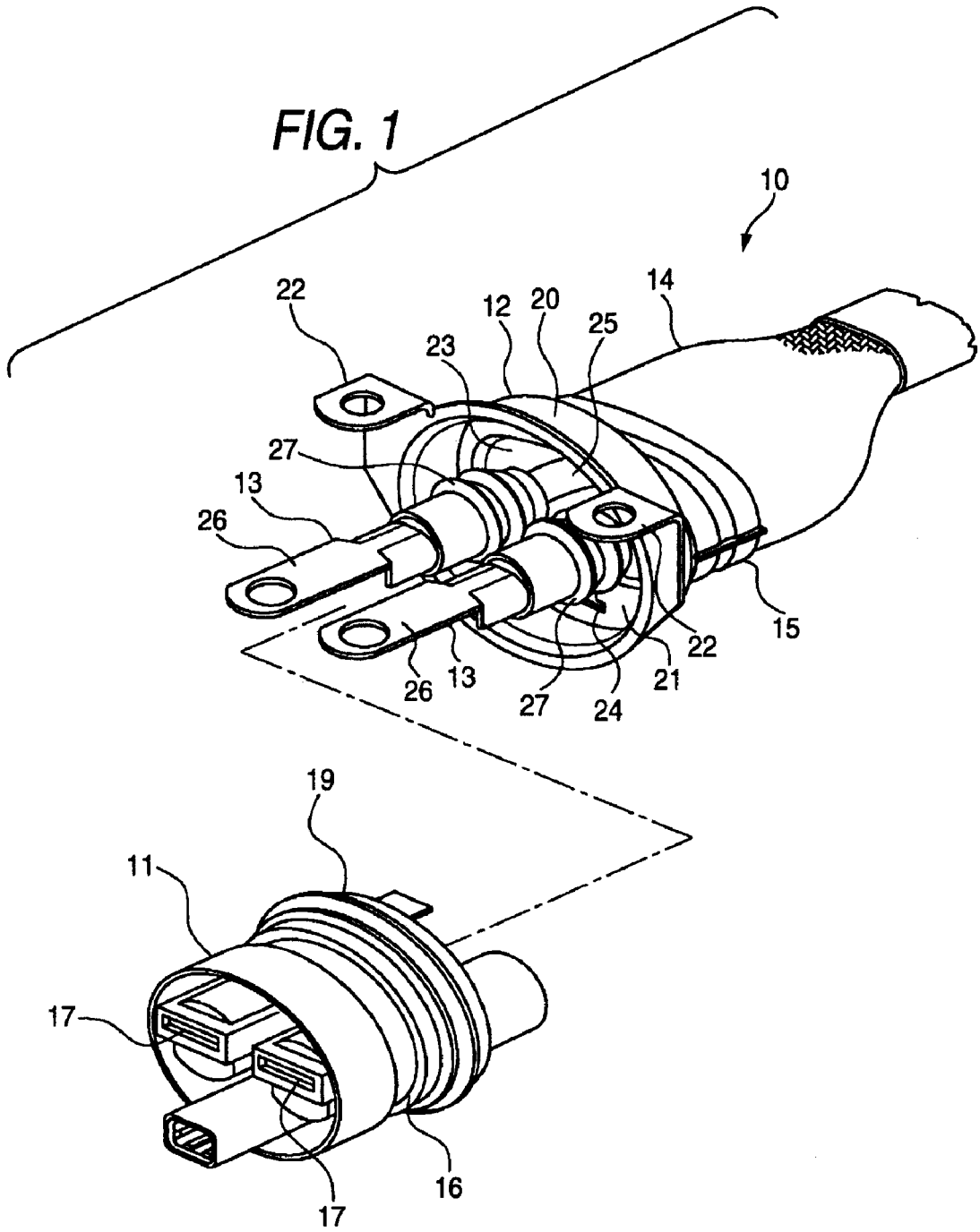
FIG. 1 is a disassembled perspective view viewed from a side of a housing of a shielded connector according to an embodiment of the invention.
Figure 2:
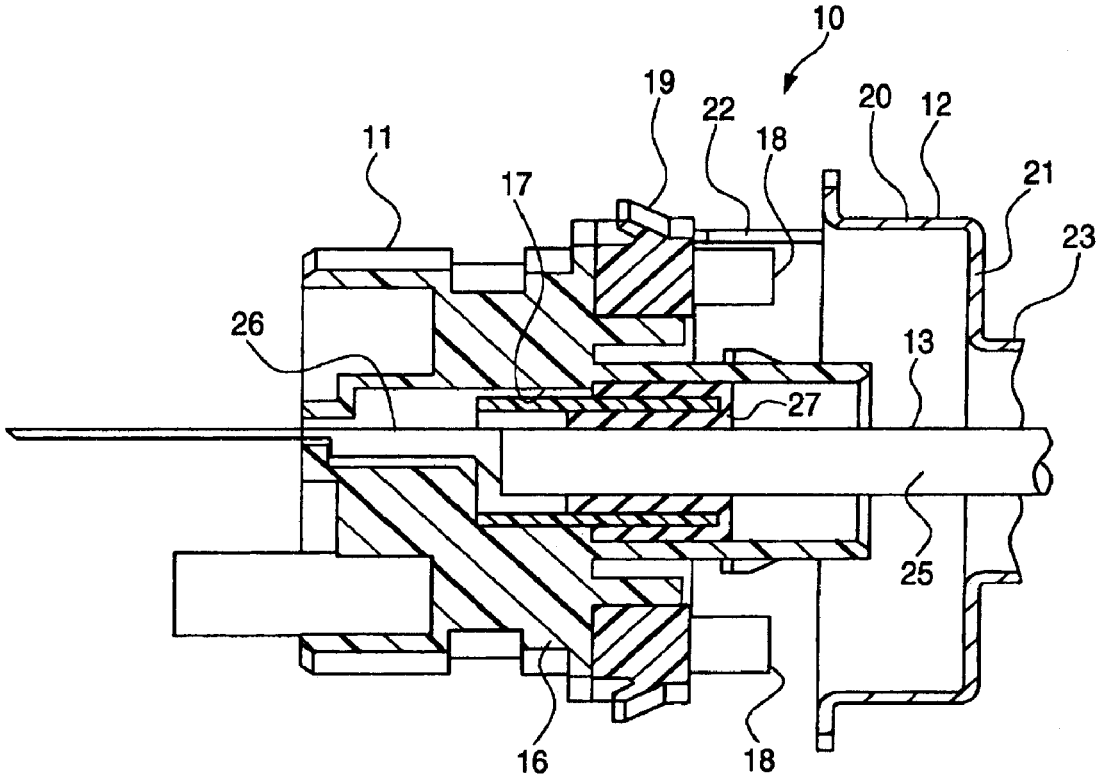
FIG. 2 is a vertical sectional view around a terminal after integrating the shielded connector of FIG. 1.
Figure 3:
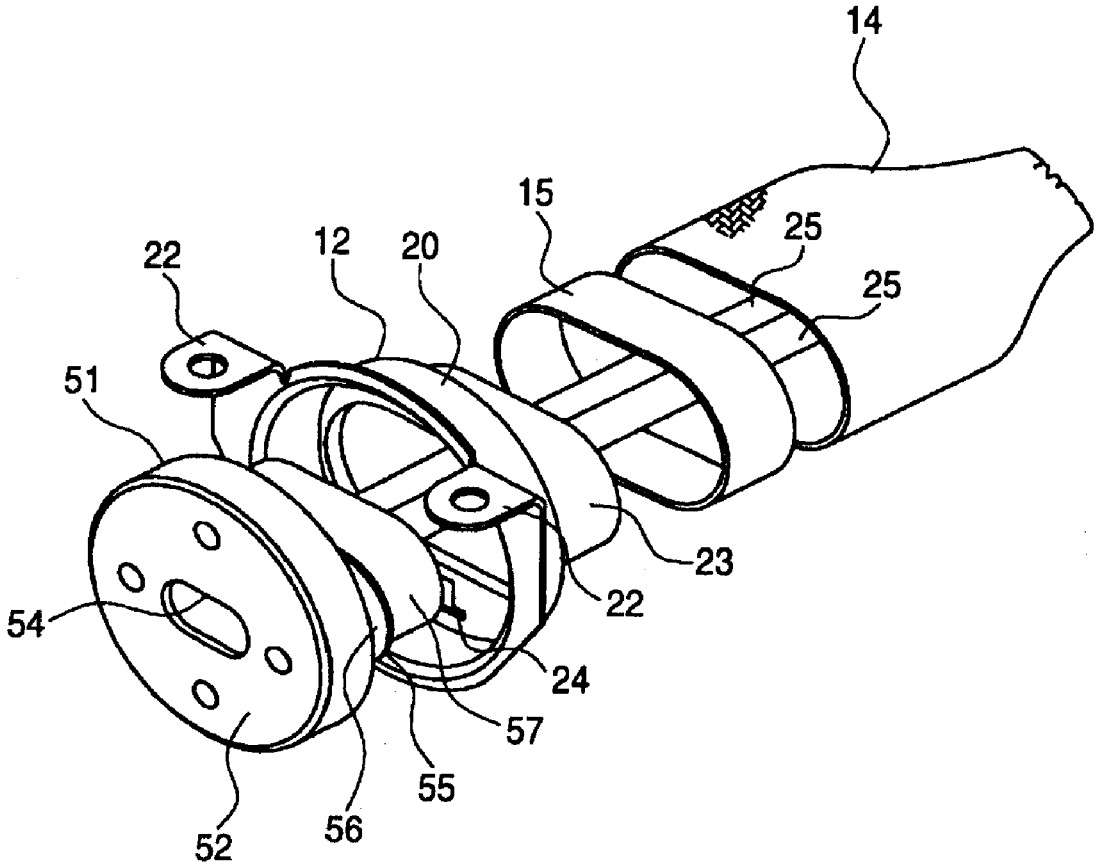
FIG. 3 is a disassembled perspective view before inserting a core for explaining a method of manufacturing the shielded connector according to the embodiment of the invention.
Figure 4:
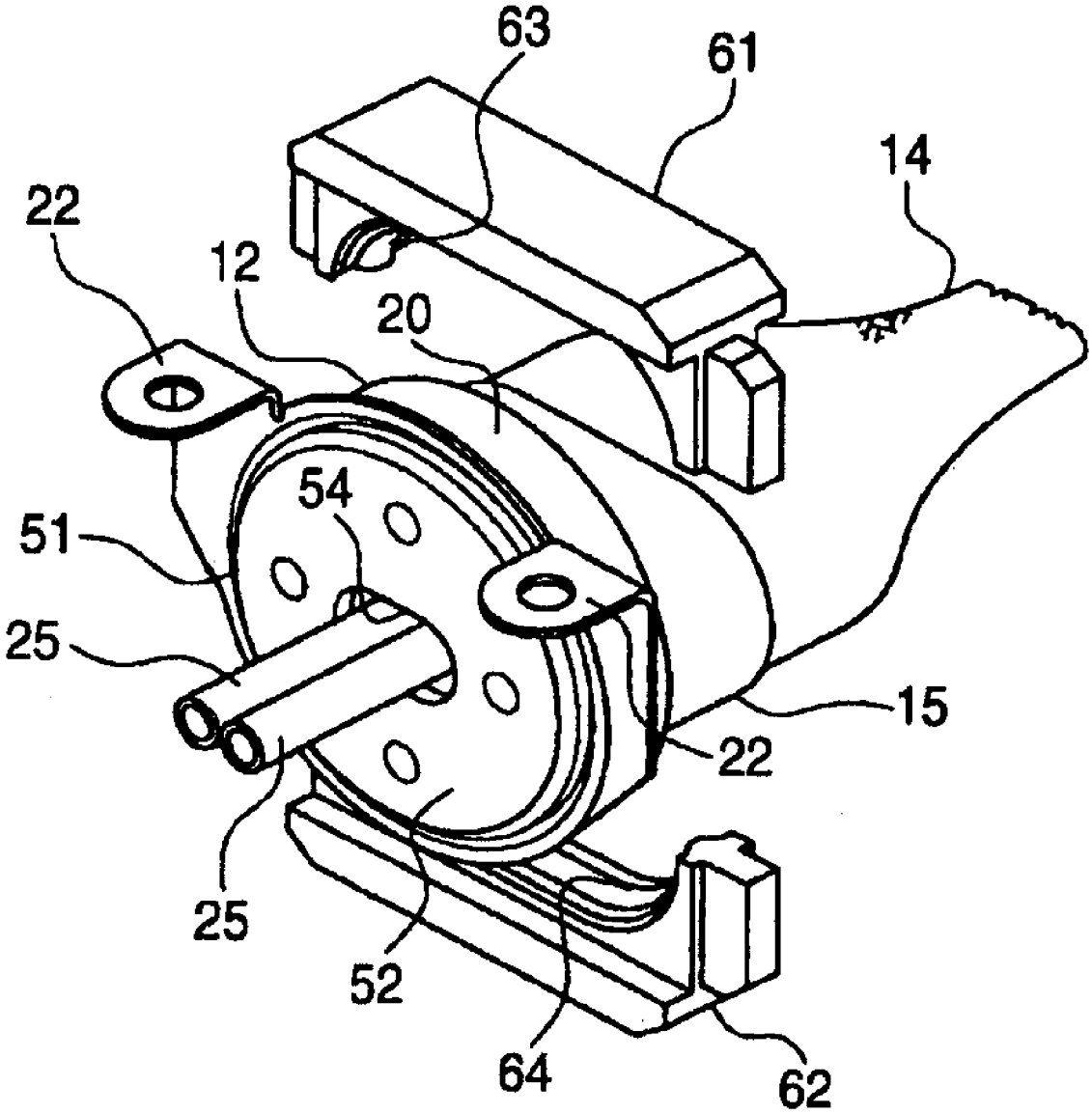
FIG. 4 is a disassembled perspective view after inserting the core for explaining the method of manufacturing the shielded connector according to embodiment of the invention.
Figure 5:
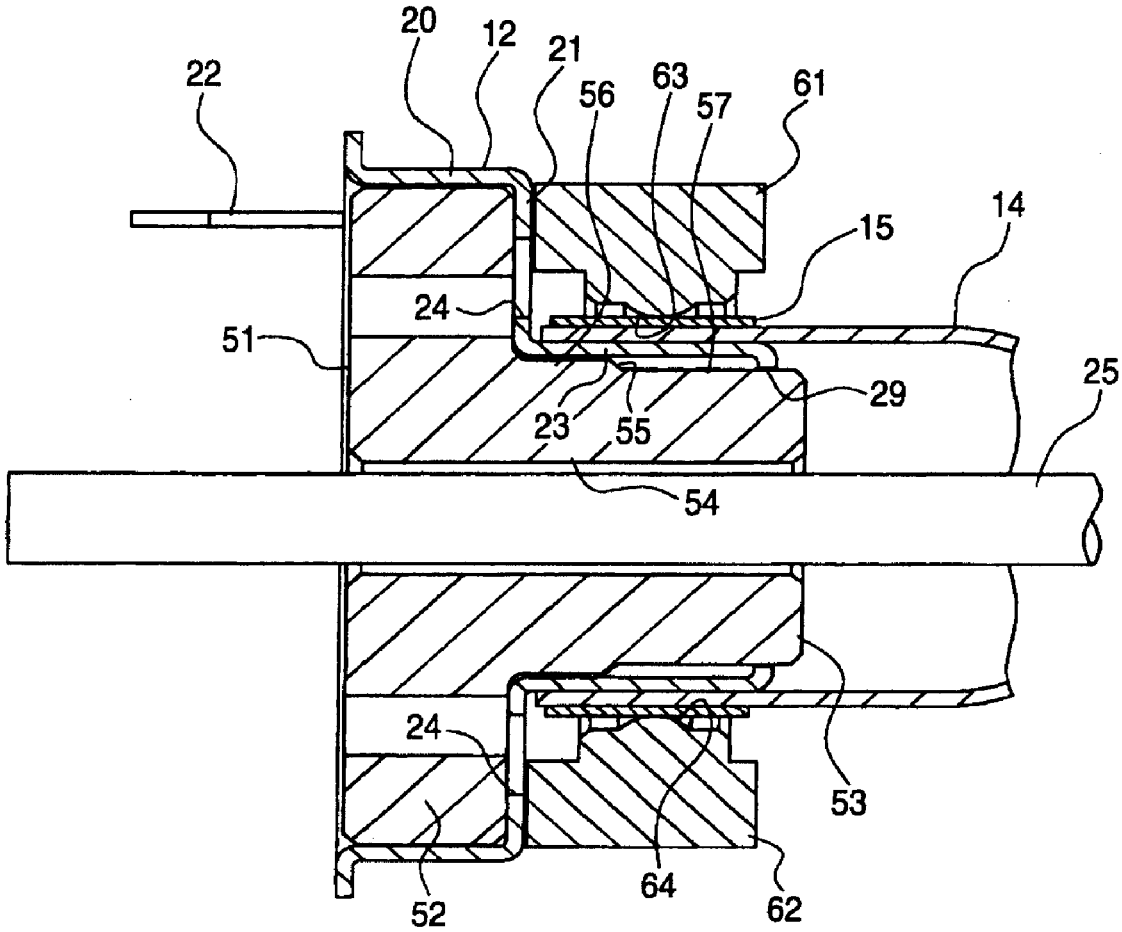
FIG. 5 is a vertical sectional view around a wire of FIG. 4.
Figure 6:
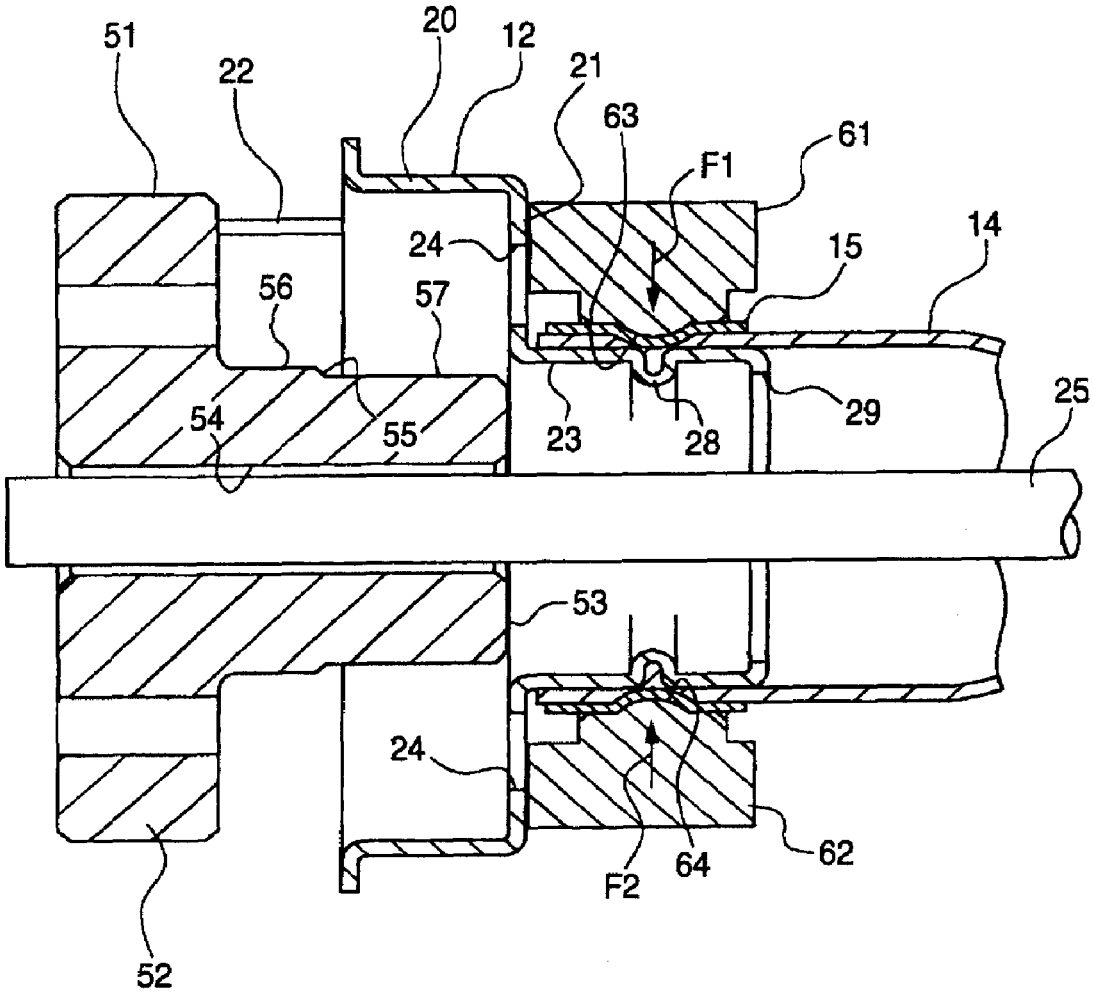
FIG. 6 is a vertical sectional view around a wire after calking for explaining the method of manufacturing the shielded connector according to the embodiment of the invention.
Figure 7:
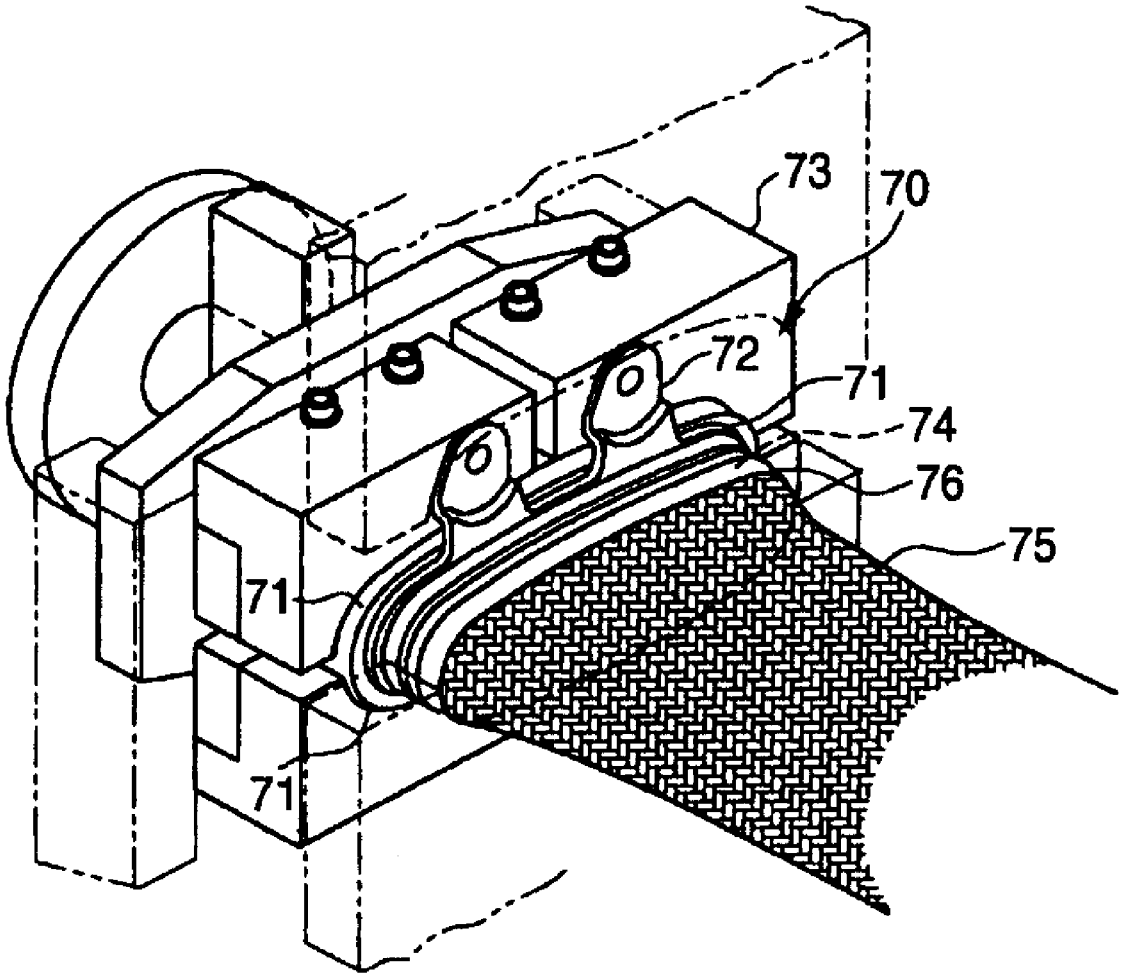
FIG. 7 is an outlook view of a shielded connector of a background art.

FIG. 1 through FIG. 6 show an embodiment of a shielded connector and a method of manufacturing a shielded connector according to the invention, FIG. 1 is a disassembled perspective view viewed from a side of a housing of a shielded connector according to an embodiment of the invention, FIG. 2 is a vertical sectional view around a terminal after integrating the shielded connector of FIG. 1, FIG. 3 is a disassembled perspective view before inserting a core for explaining a method of manufacturing the shielded connector according to the embodiment of the invention, FIG. 4 is a disassembled perspective view after inserting the core for explaining the method of manufacturing the shielded connector according to the embodiment of the invention, FIG. 5 is a vertical sectional view around a wire of FIG. 4 and FIG. 6 is a vertical sectional view around a wire after calking for explaining the method of manufacturing the shielded connector according to the embodiment of the invention.

As shown by FIGS. 1 and 2, a shielded connector 10 according to the embodiment of the invention includes a housing 11, a shielded shell 12, a terminal-attached wire 13, a knitted conductor 14, and a shield ring 15.

The housing 11 is made to function as a male connector housing, and includes a housing main body 16 formed in a shape of a circular pillar by using an insulating resin.

The housing 11 is penetrated to form in parallel with a pair of terminal cavities 17 in each of which one end portion constituting a side of a female connector housing, not illustrated, constitutes a shape of a quadrangular hole and other end portion constituting a counter female connector housing side constitutes a shape of a circular hole at a center portion of the housing main body 16.

Further, an outer edge portion of other end portion of the housing main body 16 is respectively projected to form with a pair of flexible locking pieces 18 at upper and lower opposed positions from the housing main body 16 in an axial direction.

Further, a seal member 19 is outwardly fitted to the outer edge portion of the other end portion of the housing main body 16. The seal member 19 maintains watertightness between the seal member 19 and the shielded shell 12.

The shielded shell 12 is formed by a shape of a bottomed circular ring by using a metal member having a conductivity, and includes a side plate 21 in correspondence with a bottom on a side opposed to the housing 11 of a circular ring portion 20.

The shielded shell 12 respectively includes a pair of fixing portions 22 in a shape of a flange extended to an upper side on both sides of the circular ring portion 20.

Further, the shielded shell 12 is penetrated to form with a wire inserting portion 23 projected in a shape of an oval cylinder by being folded to bend to form to a rear side of the shielded shell 12 at a center portion of the side plate 21, and an upper side and a lower side of the side plate 21 are penetrated to form with engaging holes 24 (the engaging hole 24 on the upper side is shown in FIG. 5) engaged with the flexible locking pieces 18 of the housing 11.

The terminal-attached wires 13 are respectively connected electrically with male terminals 26 at end portions of the wires 25. The terminal-attached wires 13 are covered by waterproof plugs 27 at surroundings of portions of connecting the male terminals 26 and the wires 25 and contained in the terminal cavities 17 of the housing main body 16.

The knitted conductor 14 is knitted with a plurality of knitting wires in an intersecting shape to form a grounding circuit for preventing a disturbance or the like against an electric signal passing at inside of the wire 25. The knitted conductor 14 is normally dealt with in an assembly state integrated to a surrounding of the wire 25.

The shield ring 15 is formed by a shape of a circular ring by using a metal member having a conductivity similar to the shielded shell 12, and electrically connects the knitted conductor 14 to the wire inserting portion 23 of the shielded shell 25 by being calked after being mounted to an outer side of the wire inserting portion 23 of the shielded shell 12 covered by the knitted conductor 14.

Next, a method of manufacturing the shielded connector according to the invention will be explained in reference to FIG. 3 through FIG. 6.

As shown by FIG. 3, a core 51 is used for manufacturing the shielded shell 12.

The core 51 is formed by a single member having a wire inserting hole 54 penetrated in a front and rear direction (inserting and drawing directions of the core 51 with respect to shielded shell 12) by including a main body portion 52 in a shape of a circular plate and a projected portion 53 formed in an oval shape similar to the inner shape of the wire inserting portion 23 of the shielded shell 12 from the main body portion 52. The projected portion 53 of the core 51 is provided with a stepped portion 55 substantially at a center portion in the axial direction, and the stepped portion 55 is an escape portion for containing a calk-deformed portion 28 (shown in FIG. 6) formed at the shielded shell 12 by calking and is formed at a portion other than a calked portion on a side opposed to a drawing direction of the core 51 with respect to the shielded shell 12 (a counter drawing side). That is, the projected portion 53 of the core 51 includes a first shaft portion 56 and a second shaft portion 57 having an outer diameter smaller than that of the first shaft portion 56 by way of the stepped portion 55 from a side of the main body portion 52 in a rear direction.

At a first step shown in FIG. 3, the shield ring 15 is covered onto the wires 25 integrated with the knitted conductor 14, the wires 25 are inserted from a rear side to the wire inserting portion 23 of the shielded shell 12 and the wires 25 are inserted to the wire inserting hole 54 of the core 51 on a front side of the shielded shell 12.

As shown by FIG. 4 and FIG. 5, the shielded shell 12 includes a core contact portion 29 folded to bend to form to be directed to an inner peripheral side at a rear end portion of the wire inserting portion 23. The core contact portion 29 is brought into contact with the second shaft portion 57 at a rear end portion of the wire inserting portion 23 arranged at the second shaft portion 57 on a rear side of the stepped portion 55 by way of a gap (clearance) therebetween when the core 51 is inserted to the shielded shell 12.

At a second step shown by FIG. 4, FIG. 5, and FIG. 6, the core 51 is inserted into the shielded shell 12 covered with the shield ring 15 by way of the knitted conductor 14 at the wire inserting portion 23, and an upper die 61 and a lower die 62 are progressed to calk to the core 51 from outer sides of the shield ring 15. At this occasion, the upper die 61 may be progressed to calk to the lower die 62 by fixing the lower die 62.

Further, by progressing to calk the upper die 61 and the lower die 62 to the core 51 from outer sides of the shield ring 15, a projected portion 63 of the upper die 61 and a projected portion 64 of the lower die 62 calk the shield ring 15 and the wire inserting portion 23 of the shielded shell 12 by interposing the knitted conductor 14 to the stepped portion 55 of the projected portion 53 of the core 51, and therefore, the wire inserting portion 23 of the shielded shell 12 is formed with the calk-deformed portion 28 projected to the inner peripheral side and contained in the stepped portion 55 of the projected portion 53 of the core 51.

At this occasion, the shielded shell 12 is calked by the upper die 61 and the lower die 62 in a state in which the core contact portion 29 is brought into contact with the second shaft portion 57 of the projected portion 53 of the core 51, and therefore, when a calking force F1 directed from an upper side to a lower side of FIG. 6 and a calking force F2 directed from the lower side to the upper side are exerted by the calking, an entirety of the wire inserting portion 23 arranged at the second shaft portion 57 on a rear side of the stepped portion 55 by way of the gap is not deformed.

After finishing the calking, by drawing the core 51 from the shielded shell 12 and separating the two dies 61 and 62 to upper and lower sides, the shielded shell 12 in which the knitted conductor 14 is electrically connected to the wire inserting portion 23 by way of the shield ring 15 is manufactured.

Further, as shown by FIG. 1, the shielded connector 10 is manufactured by integrating the housing 11 to the shielded shell 12 after electrically connecting the male terminals 26 to end portions of the wires 25 respectively covered with the waterproof plugs 27 and containing and fixing the male terminals 26 to the terminal cavities 17 of the housing 11.

As described above, according to the shielded connector 10 of the embodiment, when the knitted conductor 14 is interposed between the shield ring 15 and the shielded shell 12 to be calked, the single core 51 inserted to the shielded shell 12 is formed with the stepped portion 55 on the counter drawing side to contain the calk-deformed portion 28 formed at the shielded shell 12. Therefore, calking is carried out by containing the calk-deformed portion 28 formed at the shielded shell 12 at the stepped portion 55 and after finishing the calking, the core 51 is drawn by way of the stepped portion 55 formed on the counter drawing side.

Further, when the calking is carried out, the core contact portion 29 is brought into contact with the core 51 at the end portion of the wire inserting portion 23 of the shielded shell 12, and therefore, the shielded shell 12 is difficult to be deformed also by the calking force exerted to the shielded shell 12 and the shape can be maintained without deforming the entirety of the shielded shell 12. Thereby, in addition to that it is not necessary to divide the core as in the background art, a shielded connector can simply be manufactured, is advantageous in view of cost and can stably be integrated.

Further, according to the method of manufacturing the shielded connector of the embodiment, when the single core 51 is inserted into the shielded shell 12, the core contact portion 29 of the shielded shell 12 is brought into contact with the core 51, and the shield ring 15 is covered onto the shielded shell 12 by way of the knitted conductor 14. Next, the knitted conductor 14 and the shielded shell 12 are calked from outer sides of the shield ring 15. At this occasion, the core 51 is formed with the stepped portion 55 on the counter drawing side to contain the calk-deformed portion 28 formed at the shielded shell 12 by calking, and therefore, the core 51 is drawn in the drawing direction after calking has been carried out.

Further, when the calking is carried out, the core contact portion 29 is brought into contact with the core 51 in the shielded shell 12, and therefore, the shielded shell 12 is difficult to be deformed also by the calking force exerted to the shielded shell 12 and the shape of not deforming the entirety of the shielded shell 12 can be maintained. Thereby, in addition to that it is not necessary to divide the core as in the background art, a manufacturing method by which the shielded connector can simply be manufactured, is advantageous in view of cost and can stably be integrated can be provided.

Further, the invention is not limited to the above-described embodiment but can pertinently be modified or improved. Otherwise, materials, shapes, dimensions, numerical values, modes, numbers, arranging locations and the like of respective constituent elements of the above-described embodiment are arbitrary and not limited so far as the invention can be achieved.

For example, a plurality of pieces of two pieces or more of the terminal-attached wires may be constituted in place of two pieces thereof illustrated. In that case, the terminal cavities of the housing are formed by number in accordance with the number of pieces of the terminal-attached wires.

What is claimed is:

1. A method of manufacturing a shielded connector which includes:

a terminal-attached wire in which a terminal is connected to an end portion of a wire;

a housing containing the terminal of the terminal-attached wire;

a shielded shell integrated to the housing;

a knitted conductor outwardly mounted to the wire; and a shield ring interposing the knitted conductor between the shield ring and the shielded shell so that the knitted conductor is electrically connected to the shielded shell, the method comprising:

inserting, into the shielded shell, a single core having a stepped portion which is formed on a side opposed to a drawing direction of the core;

bringing a core contact portion formed at the shielded shell into contact with a peripheral face of the core;

covering the shield ring on the shielded shell by way of the knitted conductor; and calking the shield ring, the knitted conductor, and the shielded shell from an outer side of the shield ring so as to form, on the shielded shell, a calk-deformed portion which is contained into the stepped portion of the core.

* * * * *